US009909348B2

(12) United States Patent
Vandervelden

(10) Patent No.: US 9,909,348 B2
(45) Date of Patent: Mar. 6, 2018

(54) LEAF OF A SLIDING WINDOW OR SLIDING DOOR

(71) Applicant: REYNAERS ALUMINIUM, NAAMLOZE VENNOOTSCHAP, Duffel (BE)

(72) Inventor: Stefan Vandervelden, Berchem (BE)

(73) Assignee: REYNAERS ALUMINIM, NAAMLOZE VENNOOTSCHAP, Duffel (BE)

( * ) Notice: Subject to any disclaimer, the term of this patent is extended or adjusted under 35 U.S.C. 154(b) by 12 days.

(21) Appl. No.: 14/758,990

(22) PCT Filed: Dec. 30, 2013

(86) PCT No.: PCT/BE2013/000068

§ 371 (c)(1),
(2) Date: Jul. 2, 2015

(87) PCT Pub. No.: WO2014/107770

PCT Pub. Date: Jul. 17, 2014

(65) Prior Publication Data

US 2015/0345204 A1 Dec. 3, 2015

(30) Foreign Application Priority Data

Jan. 10, 2013 (BE) ..... 2013/0015

(51) Int. Cl.
*E05F 15/643* (2015.01)
*E06B 3/46* (2006.01)
(Continued)

(52) U.S. Cl.
CPC ..... *E05F 15/643* (2015.01); *E05B 65/08* (2013.01); *E05D 15/0626* (2013.01); *E06B 1/04* (2013.01);
(Continued)

(58) Field of Classification Search
CPC ..... E05F 15/643; E05B 65/08; E06B 1/04; E06B 3/4636; E06B 2003/7046
See application file for complete search history.

(56) References Cited

U.S. PATENT DOCUMENTS 3,648,424 A * 3/1972 Winyard ..... E06B 1/04 52/204.55
4,513,555 A * 4/1985 Johnson ..... E06B 3/4636 403/205

(Continued)

FOREIGN PATENT DOCUMENTS

EP 0822310 A2 2/1998
FR 2585399 A1 1/1987

OTHER PUBLICATIONS

International Search Report, dated Feb. 5, 2014, from corresponding PCT application.

*Primary Examiner* — Gregory J Strimbu
(74) *Attorney, Agent, or Firm* — Young & Thompson

(57) ABSTRACT

A leaf, of a sliding window or sliding door, has a top profile that is provided with at least one hardware component and which has a side profile perpendicular to the top profile, whereby the top of the top profile has a groove with undercut flanks extending in the longitudinal direction of the top profile, whereby the hardware component or hardware components is or are fastened to a first part of a connecting piece, whereby the first part has a shape that is at least partly complementary to the groove, the first part being held in the groove and locked in the longitudinal direction of the groove.

7 Claims, 9 Drawing Sheets

(51) Int. Cl.

| | |
|---|---|
| ***E06B 1/04*** | (2006.01) |
| ***E05B 65/08*** | (2006.01) |
| ***E05D 15/06*** | (2006.01) |
| *E06B 3/70* | (2006.01) |

(52) U.S. Cl.
CPC ..... *E06B 3/4618* (2013.01); *E06B 3/4636* (2013.01); *E05Y 2600/528* (2013.01); *E05Y 2600/628* (2013.01); *E05Y 2800/272* (2013.01); *E05Y 2800/276* (2013.01); *E06B 2003/7046* (2013.01)

(56) References Cited

U.S. PATENT DOCUMENTS

| | | | | |
|---|---|---|---|---|
| 4,893,435 | A * | 1/1990 | Shalit | E05F 15/643 49/139 |
| 6,321,413 | B1 | 11/2001 | Zingg | |
| 6,490,832 | B1 * | 12/2002 | Fischbach | E05F 15/643 49/360 |
| 2007/0022663 | A1 * | 2/2007 | Faflek | E06B 7/21 49/306 |
| 2010/0018123 | A1 * | 1/2010 | Hendrickson | E05D 15/0604 49/176 |
| 2012/0042574 | A1 * | 2/2012 | DeBoer | E05B 65/08 49/449 |
| 2015/0047150 | A1 * | 2/2015 | Saito | E05F 5/02 16/103 |
| 2015/0259962 | A1 * | 9/2015 | Chang | E05D 15/0626 49/404 |

* cited by examiner

LEAF OF A SLIDING WINDOW OR SLIDING DOOR

BACKGROUND OF THE INVENTION

The present invention relates to a leaf of a sliding window or sliding door and a method for providing such a leaf with a lock plate.

More specifically the invention concerns sliding windows or sliding doors with a frame fastened immovably in a wall, in which one or more wings are fastened that can slide and in which fixed leaves may also be present.

These are large windows for example that continue down to floor level and through which access can be gained to a terrace, for example, from a living room for example. They can be considered as sliding windows, but also as sliding doors. In this description only the word sliding window will be used, which also means a similar construction with a door character, thus running down to the floor and wide and high enough to act as a passageway.

DESCRIPTION OF THE RELATED ART

For aesthetic reasons there is a great demand for sliding doors with a minimal aspect. This means that the outermost frame of the sliding window is concealed as much as possible in a wall and any floor, so that the frame profiles have the minimum possible visibility and that the leaf profiles are kept as slim as possible.

Hereby the lock and a motor to drive the sliding leaf is preferably placed in the frame, so that it does not constitute a visual disturbance.

However it is difficult to firmly affix a lock plate on the leaf in order to receive a pin of the lock, because when installing a leaf in an outer frame there is no further space at the top of the leaf to perform the operations to affix the necessary hardware components, such as the lock plate or a coupling to a drive motor.

It must also be possible to release the sliding window in the event of a malfunction or blockage, and for this reason components must be accessible.

As a result in practice it is necessary to make a drive of a lock and/or a motor for moving the leaf accessible from the space closed off by the sliding window, which prevents these components from being invisibly built in, for example in a wall or in the frame.

SUMMARY OF THE INVENTION

The purpose of the present invention is to provide a solution to a least one of the aforementioned and other disadvantages, by providing a leaf of a sliding window or sliding door, whereby this leaf has a top profile that is provided with at least one hardware component and which has a side profile perpendicular to the top profile, whereby the top of the top profile has a groove with undercut flanks that extends in the longitudinal direction of the top profile, whereby the hardware component or hardware components is or are fastened to a first part of a connecting assembly, whereby this first part has a shape that is at least partly complementary to the groove and is held in the groove and is blocked in the longitudinal direction of the groove.

This has the advantage that it is easy to install such a leaf, because the connecting assembly, including a hardware component, can be affixed and removed again, by sliding it horizontally in or out of the groove, without the need for accessibility to the top, thus while the leaf is placed in the frame. For this purpose the groove must of course be open at one end.

Hereby it is possible to reach a lock and/or motor, built in a top profile of a frame, from the underside of the top profile, so that the need for access from the space that is closed off by the sliding window is eliminated, such that it is possible to build a sliding window completely into a wall, thus without accesses in this wall or mounted on this wall or on the frame.

In a preferred embodiment the connecting assembly comprises a second part to block the first part, and this second part is fastened to the side profile, whereby the side profile has a groove with undercut flanks that extends in the longitudinal direction of the profile, and the second part of the connecting assembly is held in the groove of the side profile and is blocked in the longitudinal direction of the groove.

In this way, the first part of the connecting assembly can be firmly, and thus burglar-resistant, fastened to the leaf without screwed connections, which is important because the top and side profiles are very slim and consequently cannot form any significant application points for screws.

In a further preferred embodiment the first part of the connecting assembly is provided with a cutaway and the second part of the connecting assembly is provided with a lip that fits in the cutaway, whereby the connecting assembly comprises a catch that is fastened to or through the lip such that the lip cannot slide out of the cutaway.

This is a practical way to connect both parts together.

Preferably the at least one hardware component comprises a lock plate for a lock and/or a coupling for a drive belt or drive chain.

The invention also relates to a method for providing a leaf of a sliding window or sliding door with a hardware component, whereby this leaf has a top profile and a side profile perpendicular to the top profile, whereby the top profile is provided with a groove with undercut flanks on the side oriented upwards that extends in the longitudinal direction of the top profile, whereby the hardware component is affixed to a first part of a connecting assembly, and this first part has a shape that is at least partly complementary to the groove, whereby the leaf is placed in a frame without the hardware component being affixed to the leaf, whereby the first part is then slid in the groove from the side of the leaf and whereby the first part is then blocked.

In this way hardware components can easily and firmly be reversibly fastened to the leaf while it is already in the frame and there is thus no accessibility from the top of the leaf. There is consequently no further reason to make a frame accessible from the side, so that the entire frame can be better built into a wall such that the frame profile has the least possible visibility.

In a preferred variant the hardware component concerns a lock plate for a lock and/or a coupling for a drive belt or drive chain.

In a further preferred variant the first part is blocked by means of a second part of the connecting assembly that is fastened to the side profile, and this second part is fastened to the leaf through the side profile being provided with a groove with undercut flanks that extends in the longitudinal direction of the side profile, whereby the second part has a shape that is at least partly complementary to the shape of the groove of the side profile and whereby the second part is slid upwards in the groove of the side profile until the second part blocks the first part, after which the second part is blocked in the groove of the side profile.

In a further preferred variant the second part is placed in the groove on the side profile via a section of the side profile where at least one flank is missing.

This is an easy way to introduce the second part into the groove on the side panel, whereby such a section must of course be provided on the side profile.

BRIEF DESCRIPTION OF THE DRAWING FIGURES

With the intention of better showing the characteristics of the invention, a preferred embodiment of a leaf and a method according to the invention is described hereinafter by way of an example, without any limiting nature, with reference to the accompanying drawings, wherein:

FIG. 3 shows the sliding window in the situation of FIG. 2 according to the cross-section III-III;

DETAILED DESCRIPTION OF THE INVENTION

Figure 1:
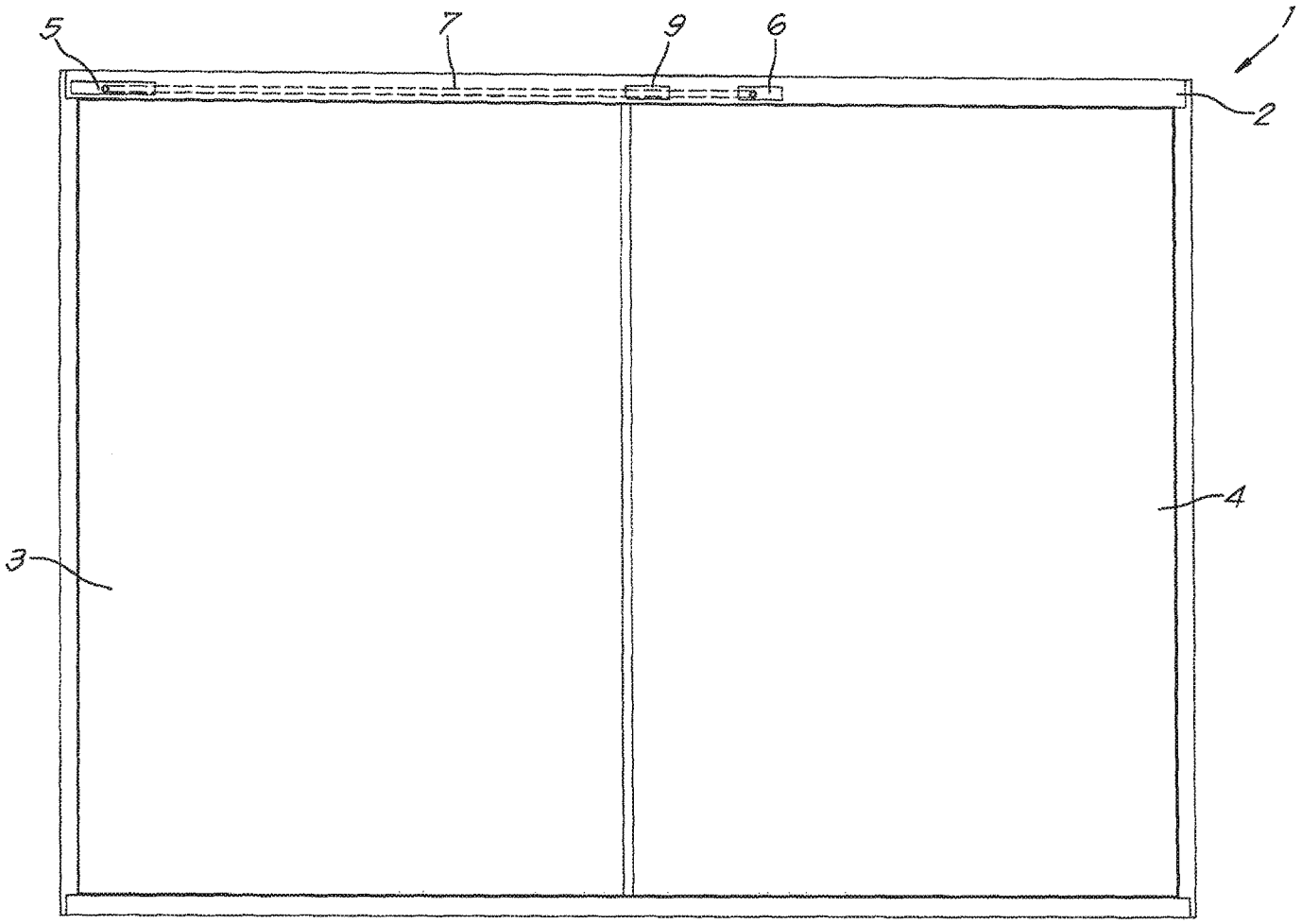
FIG. 1 shows an outside view of a sliding window provided with a leaf according to the invention.

The sliding window 1 shown in FIG. 1 comprises a frame 2, a fixed leaf 3 and a slidable leaf 4.

In order to be able to move the slidable leaf 4, a motor 5 is provided that is connected to the slidable leaf 4 via a drive belt 7 running over a reversing roller 6 and a connecting assembly 8, not shown in FIG. 1. A lock 9 is also provided that can lock the slidable leaf 4 in a closed position together with a lock plate 10 provided on the connecting assembly 8.

The motor 5, reversing roller 6, lock 9 and drive belt 7 are schematically indicated in FIG. 1, although they are affixed in the frame 2 and are thereby enclosed and thus not visible from the outside.

The motor 5, reversing roller 6, drive belt 7 and lock 9 are built into the top of the frame 2, as can be particularly seen in FIG. 3. A coupling 11 is affixed on the drive belt 7 by means of which the drive belt 7 is coupled to the slidable leaf 4.

Figure 7:
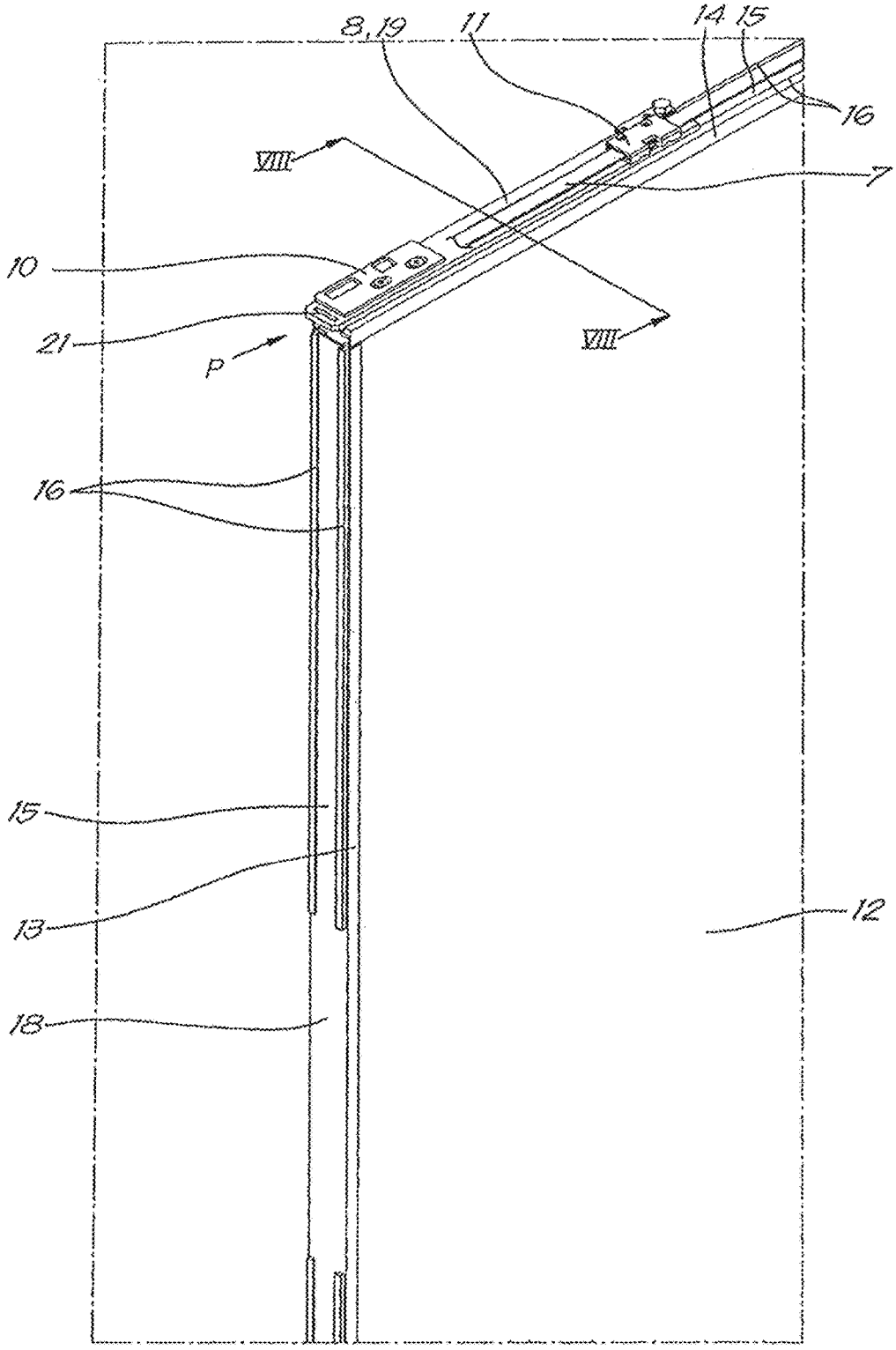
FIG. 7 is an enlarged view of a part F7 of the leaf of FIG. 6.
Figure 8:
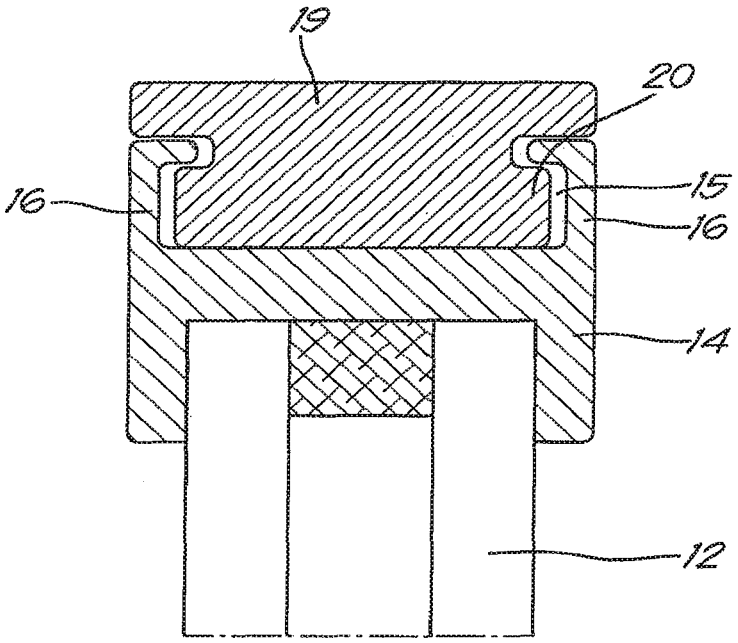
FIG. 8 shows a cross-section of a part of the leaves according to line VIII-VIII.

The slidable leaf 4 primarily consists of a glass panel 12 that is provided on its sides and top with a side profile 13 or a top profile 14. These side and top profiles 13, 14 in this example have, but not necessarily, identical cross-sections. They are, as is particularly clear from FIGS. 7 and 8, provided with a groove 15 with undercut flanks 16 oriented towards the outside, thus away from the glass panel 12. On the underside the glass panel 12 is provided with a similar profile on which small wheels 17 are mounted.

A side profile is provided with a section 18 where both flanks 16 are not present because they have been removed, such that at the location of this section 18 there is no groove 15.

A first part 19 of the connecting assembly 8 is mounted in the groove 15 of the top profile 14. The coupling 11 of the drive belt 7 is mounted in this first part 19, along with a lock plate 10 for the lock 9.

The first part 19 has a coupling part 20 with a shape that is complementary to the groove 15. The first part 19 can be manufactured in various different ways, from one piece, or from a number of components. The first part 19 is provided with a cutaway 21 close to an end.

The first part 19 of the connecting assembly 8 is clearly shown in FIGS. 7 and 8.

The first part 19 is blocked in the groove 15 of the top profile 14 by means of a second part 22 of the connecting assembly 8.

This second part 22 is affixed in the groove 15 of the side profile 13 and partly has a shape complementary to it. The second part 22 has a lip 23 that inserts through the cutaway 21 and in which a catch 24 is affixed. As a result, the second part 22, although in principle slidable in the groove 15 of the side profile 13, cannot slide out of the first part 19. When the catch 24 is affixed to the lip 23, the first part 19 and the second part 22 are locked together and consequently the lock plate 10 and the coupling 11 are fixed on the slidable leaf 4.

Such a sliding window 1 is installed as follows.

Figure 2:
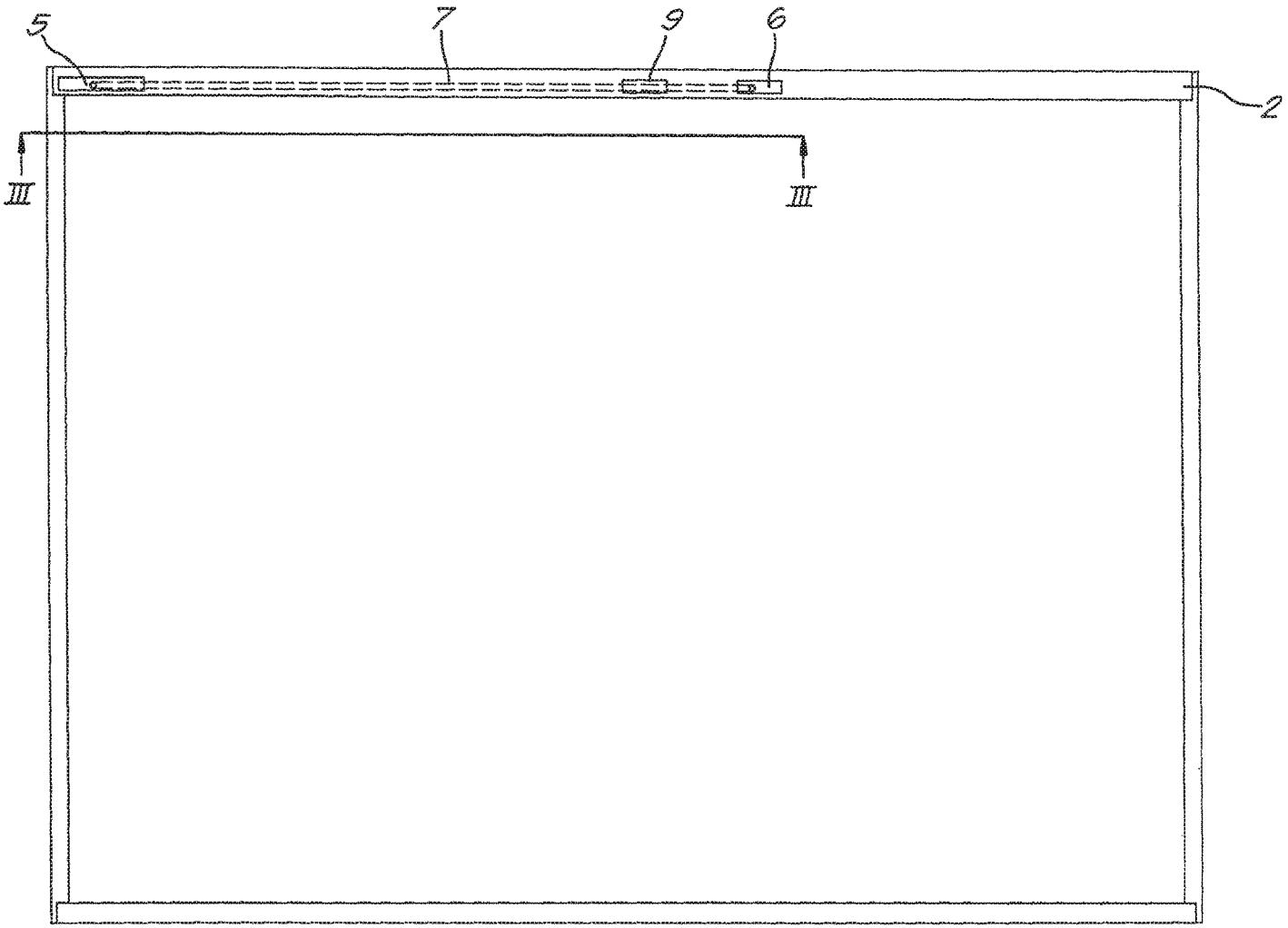
FIG. 2 shows a first situation during the installation of such a sliding window.

First, the frame 2 is installed in a wall, in a position as in FIG. 2. After the frame 2 has been installed in the wall, the wall extends around the frame 2.

Second, the slidable leaf 4 is placed in the frame 2, approximately at the position where it finally has to go.

At the top of the frame 2 where there is still no leaf 3, 4, the drive belt 7 is freely accessible.

Then, by moving the drive belt 7 by hand, the coupling 11 on the drive belt 7 is moved to a part of the frame where there is still no leaf 3, 4. The coupling 11 is then mounted on the first part 19 of the connecting assembly 8 by means of screws being inserted in holes provided for this purpose. The lock plate 10 is also mounted on this first part 19.

Figure 5:
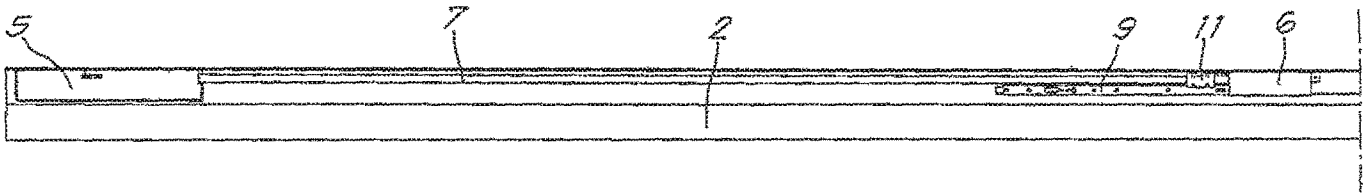
FIG. 5 shows a side view of the components of FIG. 4.
Figure 4:
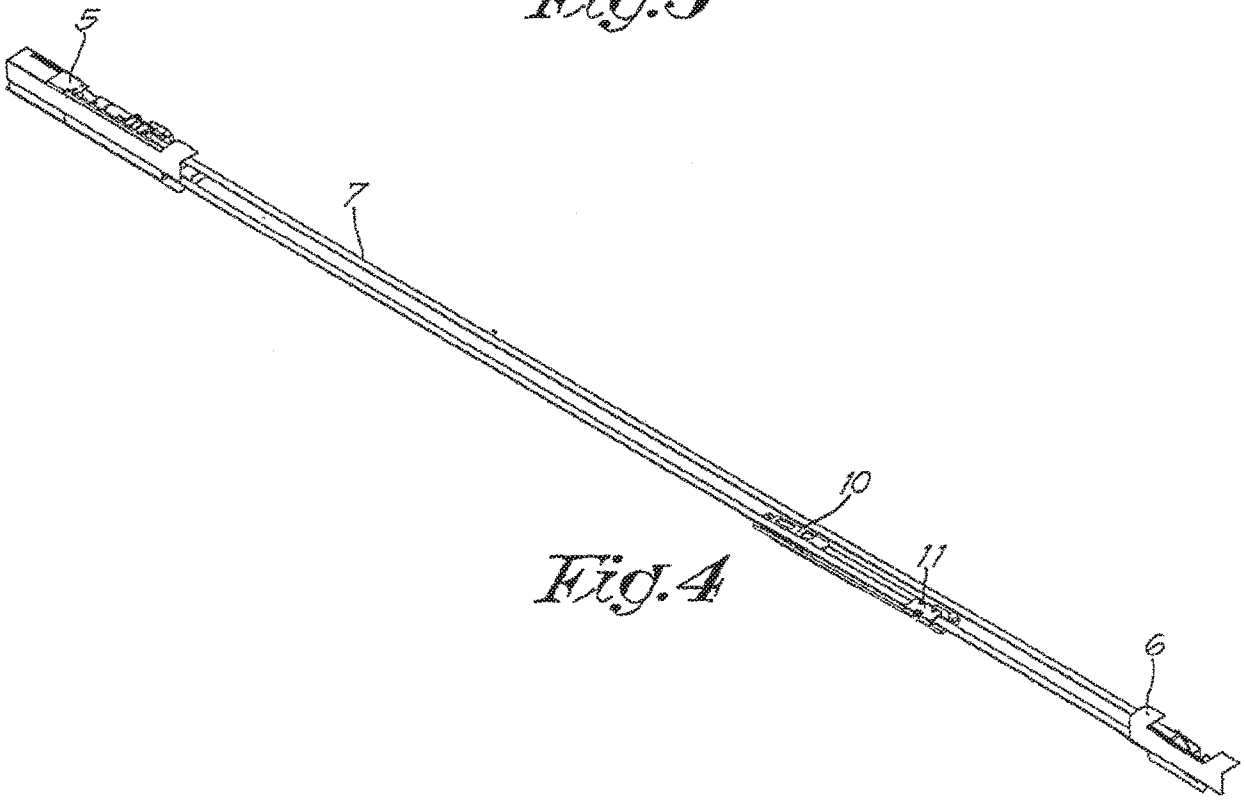
FIG. 4 shows a number of components, not visible from the outside, of the sliding window in a subsequent situation during installation.
Figure 5:
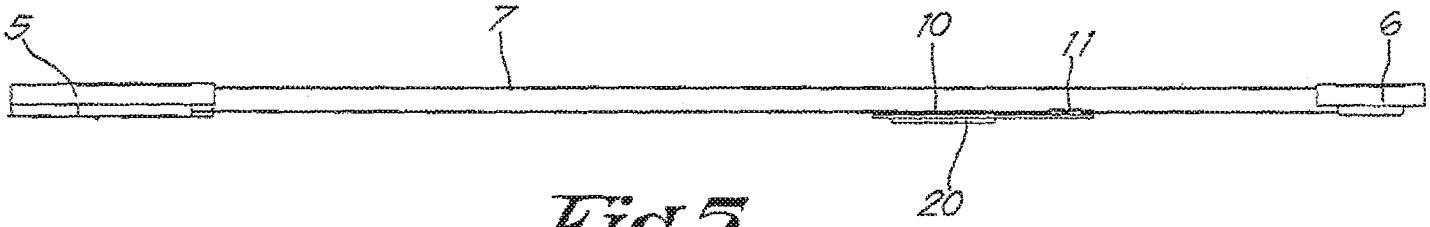
Figure 6:
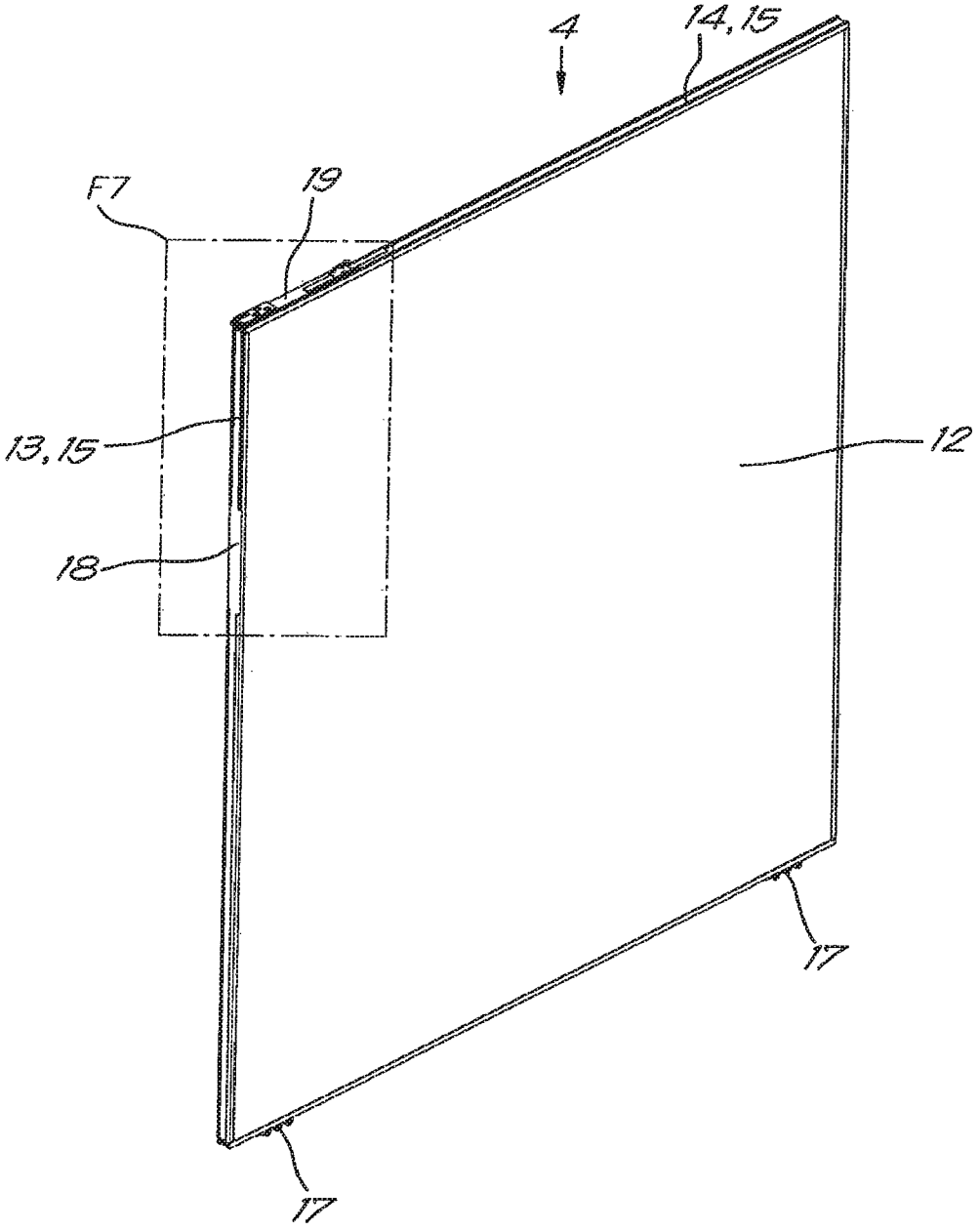
FIG. 6 shows a leaf of the sliding window in a subsequent situation during installation.

This situation is shown in FIGS. 4 and 5, whereby for clarity the frame 2 is not shown, but only the motor 5, reversing roller 6, drive belt 7 and the first part 19 of the connecting assembly 8 with the hardware components mounted on it, i.e. the coupling 11 and the lock plate 10.

These operations are relatively easy to perform, because they can be performed next to the slidable leaf 4 where there is good accessibility.

The first part 19 of the connecting assembly 8 is now slid from the side in the direction of arrow P, in the groove 15 of the top profile 14. This is shown in FIG. 7.

After the first part 19 is slid into the groove 15 of the top profile 14, the second part 22 of the connecting assembly 8 is first introduced into the groove 15 of the side profile 13 via the section 18 of the side profile 13 that has no flanks, and is second slid upwards in the direction of arrow Q until the lip 23 inserts through the cutaway 21 in the first part 19 of the connecting assembly 8, after which the catch 24 is affixed.

Figure 9:
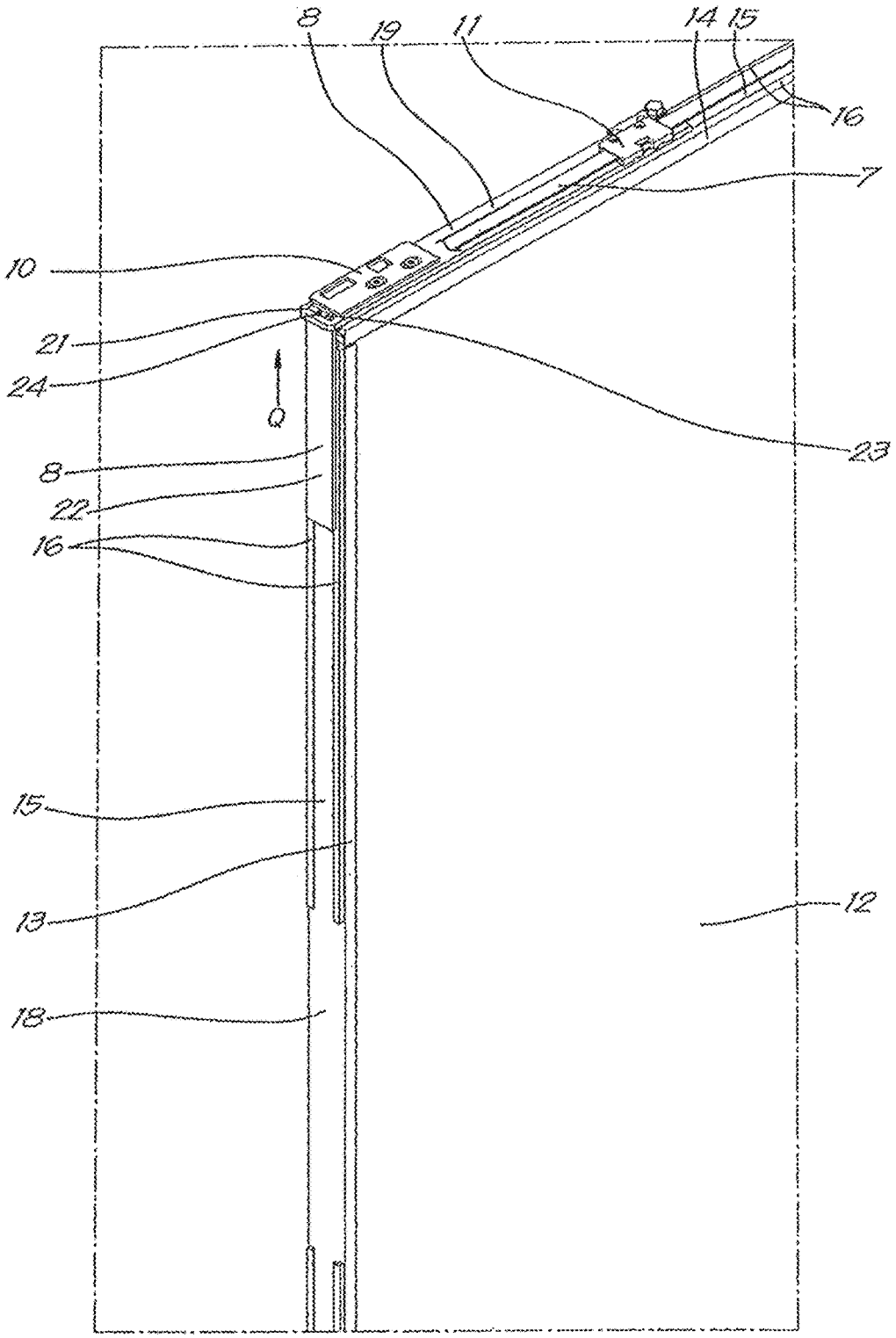
FIG. 9 is a view of the part of FIG. 7 in a further subsequent situation during installation.
Figure 10:
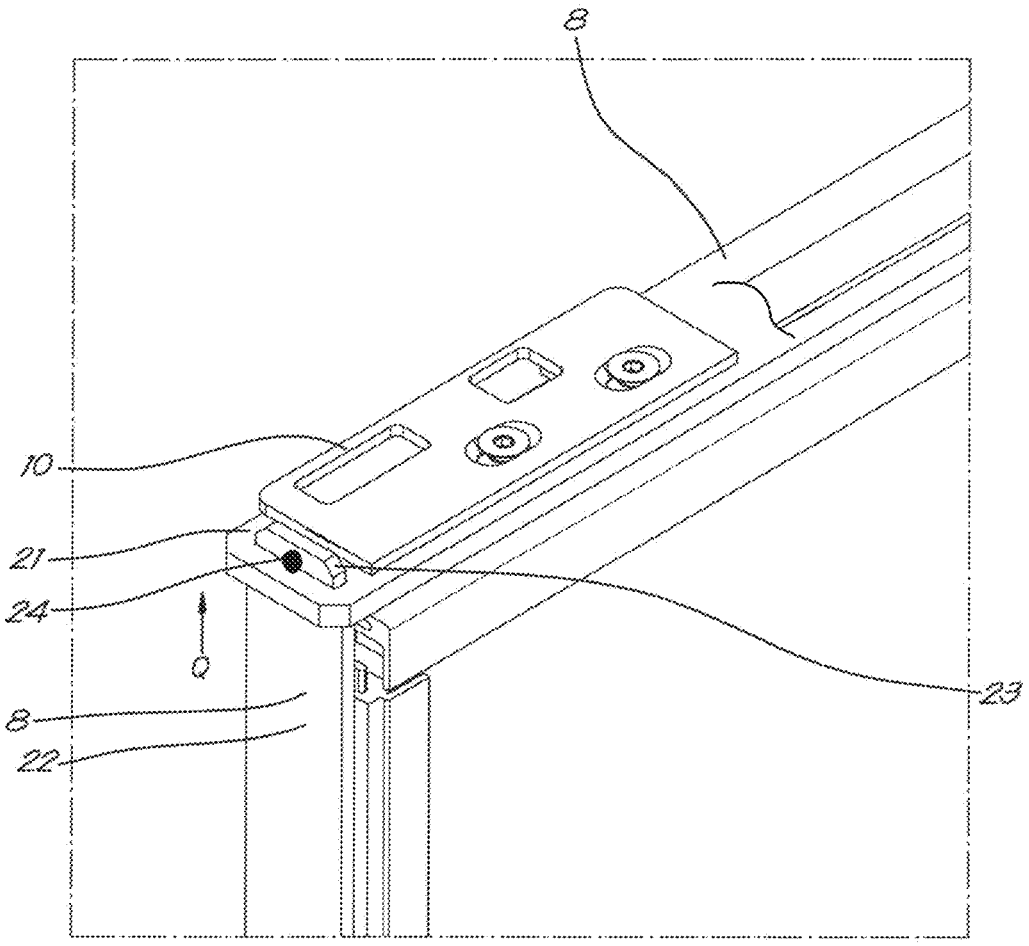
FIG. 10 is an enlargement of the upper, left corner portion of FIG. 9.

This situation is shown in FIG. 9.

The slidable leaf 4 can now be moved on the small wheels 17 in the frame 2 by means of the motor 5 and locked by means of the lock 9 and the lock plate 10.

Finally, covering profiles are affixed around the side profiles 13 in order to hide them from view and the fixed leaf 3 is placed in the frame 2. The sliding window 1 is now ready for use.

The present invention is by no means limited to the embodiments described as an example and shown in the drawings, but a sliding window or sliding door according to the invention can be realised in all kinds of forms and dimensions and according to all kinds of variant methods, without departing from the scope of the invention.

The invention claimed is:

1. A leaf (4) of a sliding window (1) or sliding door, the leaf (4) comprising:

a top profile (14), a side profile (13) perpendicular to the top profile (14), wherein a top of the top profile (14) has a first groove (15) with first undercut flanks (16) extending in a longitudinal direction of the top profile (14), wherein the side profile (13) has a second groove (15) with second undercut flanks (16) extending in a longitudinal direction of the side profile (13), a connecting assembly (8) comprising a first part (19) held in the top profile (14) and a second part (22) held in the side profile (13), wherein at least one hardware component (10, 11) is fastened to the first part (19) of the connecting assembly (8), wherein the first part (19) has a shape that corresponds to the first groove (15) of the top profile (14) and that allows the first part (19) to slide in the first groove (15) of the top profile (14) in the longitudinal direction of the top profile, wherein the second part (22) has a shape that corresponds to the second groove (15) of the side profile (13) and that allows the second part (22) to slide in the second groove (15) of the side profile (13) in the longitudinal direction of the side profile (13), wherein the first part (19) of the connecting assembly (8) is provided with a cutaway (21), wherein the second part (22) of the connecting assembly (8) is provided with a lip (23), wherein the lip (23) is inserted through the cutaway (21), and a catch (24) is affixed to the lip (23) so that the lip (23) cannot slide out of the cutaway (21) thereby locking the first and second parts (19, 22) of the connecting assembly (8) together.

2. The leaf according to claim 1, wherein the second undercut flanks (16) are not present in at least one portion of the second groove (15) of the side profile (13).

3. The leaf according to claim 2 wherein the at least one hardware component is coupling (11) for a drive belt (7) or a drive chain.

4. The leaf according to claim 2, wherein the at least one hardware component is lock plate (10) for a lock (9).

5. The leaf according to claim 1, wherein the at least one hardware component includes a lock plate (10) for a lock (9).

6. The leaf according to claim 5, wherein the at least one hardware component further includes a coupling (11) for a drive belt (7) or a drive chain.

7. A sliding window or sliding door (1), comprising:

a frame;

a leaf (4), the leaf (4) comprising:

a top profile (14), a side profile (13) perpendicular to the top profile (14), wherein a top of the top profile (14) has a first groove (15) with first undercut flanks (16) extending in a longitudinal direction of the top profile (14), wherein the side profile (13) has a second groove (15) with second undercut flanks (16) extending in a longitudinal direction of the side profile (13), a connecting assembly (8) comprising a first part (19) held in the top profile (14) and a second part (22) held in the side profile (13), wherein at least one hardware component (10, 11) is fastened to the first part (19) of the connecting assembly (8), wherein the first part (19) has a shape that corresponds to the first groove (15) of the top profile (14) and that allows the first part (19) to slide in the first groove (15) of the top profile (14) in the longitudinal direction of the top profile, wherein the second part (22) has a shape that corresponds to the second groove (15) of the side profile (13) and that allows the second part (22) to slide in the second groove (15) of the side profile (13) in the longitudinal direction of the side profile (13), wherein the first part (19) of the connecting assembly (8) is provided with a cutaway (21), wherein the second part (22) of the connecting assembly (8) is provided with a lip (23), wherein the lip (23) is inserted through the cutaway (21), a catch (24) is affixed to the lip (23) so that the lip (23) cannot slide out of the cutaway (21) thereby locking the first and second parts (19, 22) of the connecting assembly (8) together, wherein the at least one hardware component (10, 11) includes a coupling (11) which is coupled to a drive belt or a drive chain;

a motor (5), wherein the leaf (4) is disposed in the frame (2), and wherein the motor (5) is located within the frame (2) and is adapted to move the leaf (4) via the coupling (11) and the drive belt or the drive chain (7).

* * * * *